US006125724A

United States Patent [19]

Murphy et al.

[11] Patent Number: 6,125,724

[45] Date of Patent: Oct. 3, 2000

[54] ENGLISH/METRIC ADJUSTABLE WRENCH WITH DIAL

[75] Inventors: Larry K. Murphy, 6334 N. Washam, Corpus Christi, Tex. 78414; Andrew P. Conkey, Kleberg County, Tex.

[73] Assignee: Larry K. Murphy

[21] Appl. No.: 09/285,832

[22] Filed: Apr. 2, 1999

[51] Int. Cl.[7] ..... B25B 13/20

[52] U.S. Cl. ..... 81/133; 81/165; 81/DIG. 5

[58] Field of Search ..... 81/133, 165, DIG. 3, 81/DIG. 5, 134–147

[56] References Cited

U.S. PATENT DOCUMENTS

| | | |
|---|---|---|
| 1,811,148 | 6/1931 | Pehrsson . |
| 2,722,150 | 11/1955 | Green . |
| 3,948,120 | 4/1976 | Hancock . |
| 4,326,636 | 4/1982 | McGraw . |
| 4,454,791 | 6/1984 | Seward . |
| 4,653,357 | 3/1987 | Carlmark . |
| 5,048,380 | 9/1991 | Caldwell . |
| 5,183,055 | 2/1993 | Seager . |
| 5,222,419 | 6/1993 | Spector . |
| 5,305,670 | 4/1994 | Fossella . |
| 5,375,490 | 12/1994 | Carlmark . |
| 5,862,722 | 1/1999 | Cislo ..... 81/DIG. 5 |

*Primary Examiner*—D. S. Meislin
*Attorney, Agent, or Firm*—G. Turner Moller

[57] ABSTRACT

An adjustable wrench provides a fixed number of positions between fixed and movable torque applying jaws, the positions corresponding to nominal wrench sizes. One scale in English units provides means to position the jaws in a series of positions corresponding to English unit wrenches. A second scale in metric units provides means to position the jaws in a series of positions corresponding to metric wrenches. A pair of operators or discs have a pointer which is used to select the desired wrench size.

20 Claims, 1 Drawing Sheet

FIG. 1
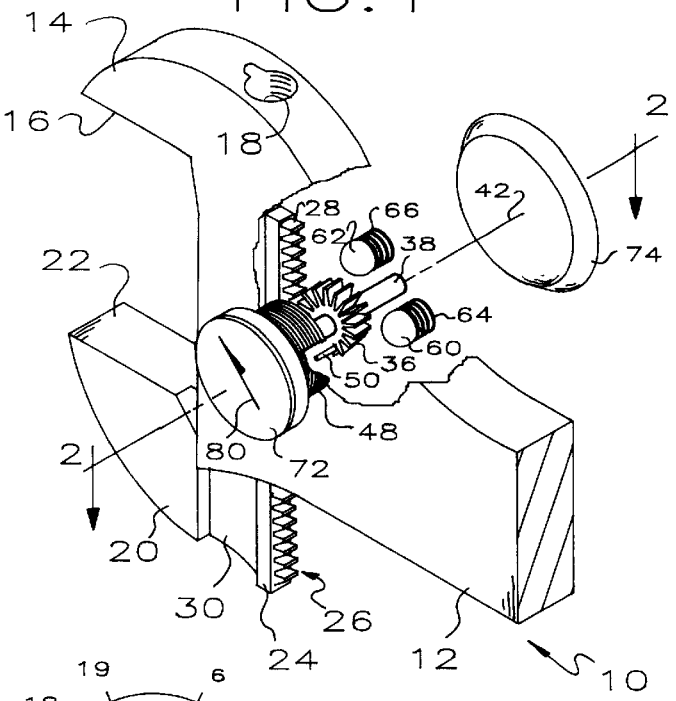
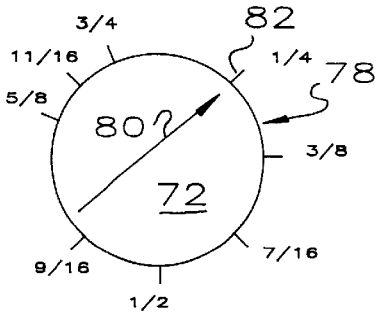
FIG. 4
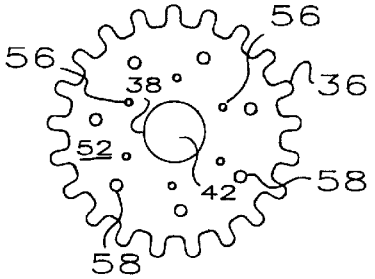
FIG. 3
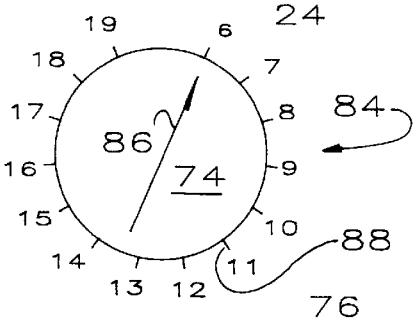
FIG. 5
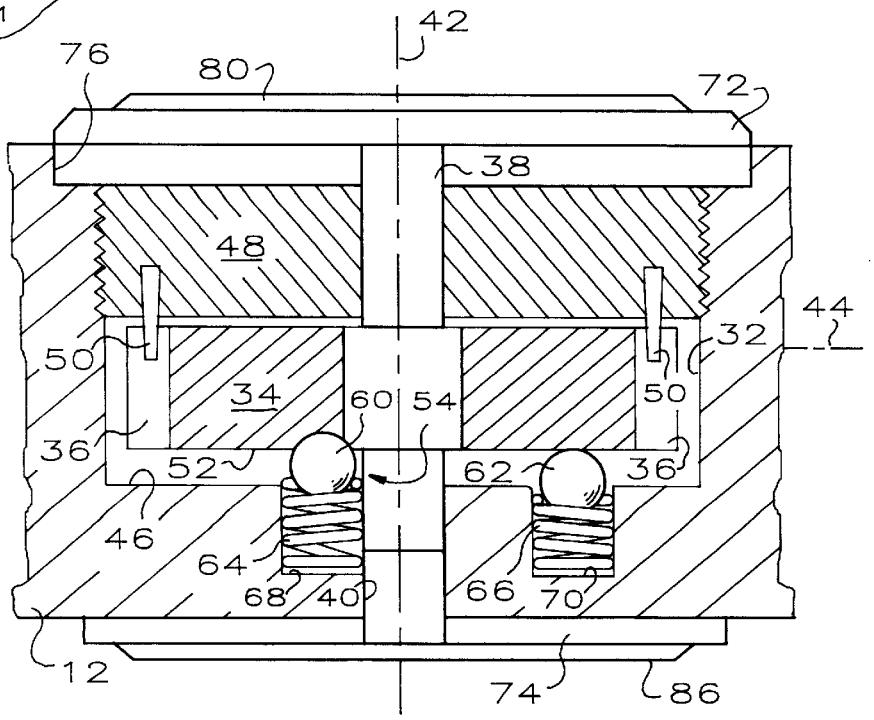
FIG. 2

ENGLISH/METRIC ADJUSTABLE WRENCH WITH DIAL

This invention relates to an adjustable wrench having a dial on opposite sides indicating the wrench size in both English and metric units.

BACKGROUND OF THE INVENTION

In one sense, there are two types of wrenches: one type has fixed fastener engaging jaws and one type has movable fastener engaging jaws. Prior art adjustable jaw wrenches are almost always continuously adjustable, of which the crescent wrench is the most common example. Continuously adjustable wrenches have an advantage because one does not need to know the size of the fastener to be worked on. One merely adjusts the wrench to fit the torque receiving faces of the fastener. On the other hand, wrenches having fixed jaws possess a number of advantages as shown by the popularity of open end and box end wrenches that has persisted for generations.

Disclosures of adjustable jaw devices of interest relative to this invention are found in U.S. Pat. Nos. D321,310; 1,811,148; 5,048,380; 5,183,055 and 5,222,419. There are a number of adjustable wrenches in the prior art that include a scale between the movable jaws so the user can determine the spacing between the movable jaws and thus determine the size of the fastener being worked on. Disclosures of this type are found in U.S. Pat. Nos. 2,722,150; 3,948,120; 4,326,436; 4,454,791; 4,653,357 and 5,375,490. None of these disclosures provide a wrench having a dial to specify the wrench size in both English and metric units.

SUMMARY OF THE INVENTION

This invention is an adjustable jaw wrench which provides a scale or dial in both metric and English measurements showing the spacing between the jaws and thus the operating size of the wrench. The adjustable jaws are movable to a finite number of operating positions, rather than being continuous adjustable, by an operator. The pointer of the dial is conveniently on the operator so the user can move the operator to an operating position shown by the dial to be a particular sized wrench. For example, if the user wants a ½" wrench, he moves the operator until the pointer lines up with the ½" indicia on the English measurement scale. If the user wants an 11 mm wrench, he moves the operator until the pointer lines up with the 11 mm indicator on the metric scale. The mechanism of the wrench positions the adjustable jaw at a distance corresponding to the reading on the scale.

In a preferred embodiment of this invention, this is accomplished by providing a wrench which superficially appears to be of the crescent type having a rack on the movable jaw engaging a spur or pinion gear in the wrench handle. The spur gear is rotatable by an operator between a finite number of operating positions, at least some of which correspond to a desired wrench size, e.g. ½", 11 mm, and the like. A locking mechanism immobilizes the spur gear at each of the operating positions.

It is an object of this invention to provide an improved adjustable jaw wrench.

A further object of this invention it to provide an adjustable jaw wrench having a scale or dial and an operator which adjusts the wrench spacing in a limited number of operating positions which correspond to one of the nominal operating sizes.

Another object of this invention is to provide an adjsutable wrench having both English and metric scales showing the nominal operating size of the wrench and a limited number of operating positions which correspond to one of the nominal operating sizes.

These and other objects of this invention will become more fully apparent as this description proceeds, reference being made to the accompanying drawings and appended claims.

BRIEF DESCRIPTION OF THE DRAWINGS

FIG. 1 is a broken exploded partial isometric view of a wrench in accordance with this invention;

FIG. 2 is an enlarged cross-sectional view of the wrench of FIG. 1, taken substantially along line 2—2 thereof, as viewed in the direction indicated by the arrows;

FIG. 3 is a cross-sectional view of the wrench of FIG. 2, taken substantially along line 3—3 thereof, as viewed in the direction indicated by the arrows and showing bottom of the pinion gear used to adjust the position of the movable jaw relative to the fixed jaw;

FIG. 4 is a view of the English measurement scale; and

FIG. 5 is a view of the metric measurement scale.

DETAILED DESCRIPTION

Referring to FIGS. 1–3, a wrench 10 of this invention is superficially of the crescent type and comprises a body or handle 12, a fixed jaw 14 having a first fastener engaging face 16 and a passage 18 for receiving part of the movable jaw 20. The movable jaw 20 includes a fastener engaging face 22 parallel to the face 16 and an elongate rib 24 received in the passage 18. A rack 26 comprising a set of linear gear teeth 28 is positioned on the edge of the rib 24. A narrow slot (not shown) in the body 12 allows a web 30 to extend beyond the edge of the body 12 and connect the rib 24 to the adjustable jaw 20. Those skilled in the art will recognize the wrench 10, as heretofore described, as being typical of a crescent type wrench.

Inside a recess 32 in the wrench body 12 is a pinion gear 34 having a series of gear teeth 36 on the periphery meshing with the teeth 28 of the rack 26. The gear 34 is fixed to a shaft 38 mounted in a passage 40 for rotation about an axis 42 perpendicular to a central plane 44 extending through the wrench 10. The shaft 38 and gear 34 are mounted for limited reciprocating movement inside the recess 32 between a bottom 46 of the recess 32 and a closure 48 which is either threaded or pressed into the upper end of the recess 32. At least one, and preferably several, pegs 50 extend from the closure 48 into the gaps between the teeth 36 and thus immobilize the gear 34 when the gear 34 is in its upper position, as viewed in FIG. 2. The pegs 50 are preferably tapered so they are easily received in the gaps between the gear teeth 36.

As shown best in FIGS. 2 and 3, the gear 34 has a flat surface 52 facing the bottom 46 of the recess 32. A detent assembly 54 comprises a first series of dimples or recesses 56 in the flat surface 52 arranged in a circle of a predetermined diameter around the axis 42. The detent assembly 54 also comprises a second series of dimples or recesses 58 arranged in a circle of a larger diameter around the axis 42. A pair of ball detents 60, 62 are biased toward the flat surface 52 by springs 64, 66 positioned in blind openings 68, 70. The ball detents 60, 62 are positioned radially relative to the axis 42 to engage the dimples 56, 58 respectively. It will accordingly be seen that the arcuate or angular position of the dimples 56, 58 and ball detents 60, 62 control the amount of rotation of the gear 34 and thus control the spacing between the fixed and movable jaws 16, 22.

A pair of operators 72, 74 are fixed to the ends of the shaft 38 in any convenient manner. As shown in FIG. 2, the springs 64, 66, acting through the ball detents 60, 62, normally bias the gear 34 away from the bottom 46 of the recess 32 so the pegs 50 enter into the gaps between the gear teeth 36 and thereby immobilize the gear 34 and thus immobilize the rack 26. It will thus be seen that the normal position of the gear 34 is in a locking mode, i.e. turning the wrench handle 12 turns a fastener received between the jaws 16, 22, because the gear 34 cannot move.

A cutout 76 in the wrench body 12 allows the operator 72 to move toward the bottom 46 of the recess 32 thereby allowing the gear 34 to move away from engagement with the pegs 50 thereby freeing the gear 34 for rotation. As shown in FIGS. 2 and 4, the wrench 10 provides a scale 78 in English measurements showing the distance between the wrench jaws 16, 22. The scale 78 includes a pointer 80 which may be a raised rib seen in FIG. 2 and a series of indicia or tick marks 82 spaced around the periphery of the operator 72. Although the pointer 80 is preferably on the operator 72, it will be apparent that the scale 78 may be between the movable jaw 20 and the body 12 of the wrench, as in the prior art.

As shown in FIGS. 2 and 5, the wrench 10 provides a scale 84 in metric measurements showing the distance between the wrench jaws 16, 22. The scale 84 includes a pointer 86 on the operator 74 which may be a raised rib seen in FIG. 2 and a series of indicia or tick marks 88 spaced around the periphery of the operator 74. Although the pointer 86 is preferably on the operator 74, it will be apparent that the scale 84 may be between the movable jaw 20 and the body 12 of the wrench, as in the prior art. It will be seen that the scales 78, 84 act as dials so the pointers 80, 86 can be used to select wrenches of different nominal sizes.

As will be more fully apparent hereinafter, the detent assembly 54 has a number of important functions. During turning of either of the operators 72, 74, the ball detents 60, 62 snap into the recesses 56, 58 with a noticeable click. This tells the user that the wrench 10 has reached a predetermined setting or spacing between the adjsutable jaws 16, 22 which corresponds with one of the wrench settings visible on the scales 78, 84. The placement of the dimples 56, 58 on the gear 34 is such that rotation of the gear 34 to a particular dimple sets the spacing between the jaws 16, 22 to a particular wrench size. The size of the wrench is seen by the user on one of the scales 78, 84, depending on whether the wrench size is in English or metric scale.

Preferably, but not necessarily, each of the dimples 56, 58 is located at an angular distance from a starting position which produces a spacing between the jaws 16, 22 that correspond to one wrench size. In other words, it is preferred that each click that occurs during movement of the operator 72 advances the jaws 16, 22 to a particular wrench size but additional dimples 56, 58 may be provided without interfering with the operation of the wrench of this invention because the user should view the dial 78,84 to determine the wrench setting. The starting position is conveniently where the jaws 16, 22 abut in a closed jaw position but may be some other position, e.g. slightly open. It is desired to provide a wrench in which the jaws 16, 22 may be positioned at a number of English measurement wrench sizes and at a number of metric measurement wrench sizes.

At first blush, this is very difficult because there are fourteen metric wrench sizes between 6 mm and 19 mm and nine English wrench sizes, every 1/16", between 1/4" and 3/4". If there were one dimple for each wrench size, both English and metric, this would require twenty three dimples in the bottom of the gear 34. This would require that the wrench body 12 would be unduly large or require that the size of the dimples 56, 58 and the ball detents 60, 62 be unduly small.

As will be more fully apparent hereinafter, because of the actual sizes of fasteners and the tolerances to which both fasteners and wrenches are made, many of the dimples will provide a setting for one metric size wrench and one English size wrench. Because of the tolerances involved in wrenches and fasteners, there are a few wrench sizes that are not close enough that a separate dimple must be provided for each. This technique dramatically reduces the number of required dimples and thus simplifies the gear 34 and makes a dual function wrench practical.

For very sound reasons, fasteners and fixed jaw wrenches are not made to exacting tolerances. Why spend time and effort to make the torque receiving faces of fasteners precisely the nominal size? Measurement of a sample of conventional threaded nuts is shown in Table I:

TABLE I

| nominal size of nut | measured spacing between torque receiving faces | difference between nominal and measurement |
|---|---|---|
| 1/2" | .4275" | .0725" |
| 9/16" | .4925" | .07" |
| 5/8" | .5525" | .0725" |
| 11/16" | .6195" | .068" |
| 3/4" | .6775" | .0725" |

It will accordingly be seen that, in this batch of nuts, the actual distance between the torque receiving faces is roughly seventy thousands of an inch smaller than the nominal size of the fastener and all of the fasteners are smaller than their nominal size which is also the nominal size of the wrench.

Similarly, the distance between the fixed jaws of open end wrenches are not made to be the same as the nominal size of the wrench. A metric and an English open end wrench set was measured with the results shown in Table II:

TABLE II

| nominal size of wrench | nominal size in English units | measured distance between torque faces, in | difference between nominal and measured | difference between English wrench and nearest metric wrench |
|---|---|---|---|---|
| 6 mm | .2362" | .261" | −.0248" | |
| 7 mm | .2756" | .2835" | −.0079" | |
| 8 mm | .3150" | .3265" | −.0115" | |
| 9 mm | .3543" | .3675" | −.0132" | |
| 3/8" | .3750" | .3620" | +.0130" | .0055" |
| 10 mm | .3937" | .4075" | −.0138" | |
| 7/16" | .4375" | .4295" | +.0080" | .0180" |
| 11 mm | .4331" | .4475" | −.0144" | |
| 12 mm | .4724" | .4815" | −.0091" | |
| 1/2" | .5000" | .4950" | +.0050" | .0135" |
| 13 mm | .5118" | .5195" | −.0076" | |
| 9/16" | .5625" | .5575" | +.0050" | .0120" |
| 14 mm | .5512" | .5695" | −.0183" | |
| 15 mm | .5905" | .6045" | −.0139" | |
| 5/8" | .6250" | .6320" | −.0070" | .0160" |
| 16 mm | .6299" | .6480" | −.0181" | |
| 11/16" | .6875" | .6910" | −.0035" | .0010" |
| 17 mm | .6693" | .6920" | −.0227" | |
| 18 mm | .7087" | .7200" | −.0113" | |
| 19 mm | .7480" | .7605" | −.1250" | |
| 3/4" | .7500" | .7495" | +.0005" | .0110" |

It will accordingly be seen that, in this batch of wrenches, the actual distance between the torque receiving faces varies substantially from the nominal size. In order to make a simplified device, one wants to choose a number of dimple spacings that correspond to both an English size wrench and a metric size wrench. Table II illustrates that a number of such selections are easily available, e.g. a ⅜" wrench and a 9 mm wrench are almost exactly the same size and an 11/16" wrench and a 17 mm wrench are almost exactly the same size. Thus, a single dimple positioned correctly will produce a spacing between the wrench jaws 16, 22 that will accept both a nominal ⅜" fastener and a nominal 9 mm fastener, given the tolerances that exist in conventional fasteners. It is also clear that a modest amount of judicial selection of dimple spacings will reduce the number of detent recesses necessary to produce a fair number of wrench sizes. This reduces the number of dimples 56, 58 required and thereby simplifies the gear 34. It will accordingly be seen that the dimples 56, 58 are not necessarily equidistantly spaced.

Although there can be some variation in the spacing of the dimples 56, 58 and thus vary the spacing of the jaws 16, 22, Table III shows a sample selection for a wrench of this invention:

TABLE III

| nominal size of wrench | nominal size in English units | manufactured distance between torque faces, in | difference between nominal and manufactured | dimple number |
|---|---|---|---|---|
| 6 mm | .2362" | .2450" | −.0088" | 1 |
| ¼" | .2500" | .2450" | +.0050" | 1 |
| 7 mm | .2756" | .2835" | −.0079" | 2 |
| 8 mm | .3150" | .3150" | −.0025" | 3 |
| 5/16" | .3125" | .3150" | −.0025" | 3 |
| 9 mm | .3543" | .3650" | −.0107" | 4 |
| ⅜" | .3750" | .3650" | +.0100" | 4 |
| 10 mm | .3937" | .4075" | −.0138" | 5 |
| 7/16" | .4375" | .4350" | +.0025" | 6 |
| 11 mm | .4331" | .4350" | −.0019" | 6 |
| 12 mm | .4724" | .4850" | −.0126" | 7 |
| ½" | .5000" | .4950" | +.0150" | 7 |
| 13 mm | .5118" | .5195" | −.0076" | 8 |
| 9/16" | .5625" | .5550" | +.0075" | 9 |
| 14 mm | .5512" | .5550" | −.0038" | 9 |
| 15 mm | .5905" | .6045" | −.0139" | 10 |
| ⅝" | .6250" | .6275" | −.0025" | 11 |
| 16 mm | .6299" | .6275" | −.0024" | 11 |
| 11/16" | .6875" | .6850" | −.0025" | 12 |
| 17 mm | .6693" | .6850" | −.0157" | 12 |
| 18 mm | .7087" | .7200" | −.0113" | 13 |
| 19 mm | .7480" | .7500" | −.0020" | 14 |
| ¾" | .7500" | .7500" | +.0000" | 14 |

In this table, the third column shows the designed jaw spacing that is controlled by manufacturing operations. It is recognized that actual jaw spacing will vary somewhat, given normal manufacturing tolerances. It will be noticed that the manufactured jaw spacing of those wrench sizes that do not share a dimple are the same as in Table II, i.e. these wrenches sizes are the same as common commercial sizes.

It will be noted that every English unit wrench is paired with a metric unit wrench. In this manner, only fourteen positions are required to provide twenty three wrenches of English and metric sizes. It will be seen that the same number of fixed wrench positions would be required to provide a wrench having only fourteen metric positions.

Operation and use of the wrench 10 should now be apparent. When the user wants to work on a nominal ½" fastener, he depresses and then rotates the operator 72 until the pointer 80 aligns with the tick 82 adjacent the ½ indicia. When this alignment occurs, there is a noticeable click when one of the ball detents 60, 62 drops into its associated recess 56, 58. Rotation of the operator 72 also rotates the gear 34 which operates through the rack 26 to adjust the jaw 22 relative to the jaw 16. When the pointer 80 aligns with the tick mark 82 adjacent the ½ indicia, the spacing between the jaws 16, 22 is appropriate to work on ½" fasteners.

When one wants to work on a nominal 9 mm fastener, he either pries up the operator 74 or depresses the operator 72 until the peg 50 clears the gear 34 and then rotates the operator 76 until the pointer aligns with the tick 86 adjacent the 9 mm indicia. When this alignment occurs, there is a noticeable click when one of the ball detents 60, 62 drops into its associated recess 56, 58. Rotation of the operator 74 also rotates the gear 34 which operates through the rack 26 to adjust the jaw 22 relative to the jaw 16. When the pointer 86 aligns with the tick mark 86 adjacent the 9 mm indicia, the spacing between the jaws 16, 22 is appropriate to work on 9 mm fasteners.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

What is claimed is:

1. An adjustable wrench having a body providing a wrench handle and a first jaw;

an adjustable assembly including an adjustable second jaw having a rack and cooperating with the first jaw to provide a wrench;

a scale having a first element on the body and a pointer on the adjustable assembly cooperating with the first element to show a series of nominal fastener sizes;

means for moving the adjustable jaw relative to the first jaw comprising a gear meshing with the rack and a rotatable operator having the pointer thereon, comprising part of the adjustable assembly, for rotating the gear and thereby reciprocating the rack and the adjustable jaw relative to the first jaw;

means connecting the operator and the gear for moving the gear through a path of movement including a series of predetermined fixed positions corresponding to the series of nominal fastener sizes so the nominal distance between the jaws in each of the predetermined positions corresponds to the nominal fastener sizes; and means for immobilizing the jaws in each of the predetermined fixed positions.

2. The adjustable wrench of claim 1 wherein the scale includes a first set of indicia displaying the nominal distance between the jaws in metric units.

3. The adjustable wrench of claim 1 wherein the scale includes a first set of indicia displaying the nominal distance between the jaws in English units.

4. The adjustable wrench of claim 3 wherein the scale includes a second set of indicia displaying the nominal distance between the jaws in metric units.

5. The adjustable wrench of claim 4 wherein the pointer cooperates with the first set of English unit indicia and further comprising a second operator, comprising part of the adjustable assembly, for rotating the gear and thereby reciprocating the rack and the adjustable jaw relative to the first jaw and having a second pointer thereon;

wherein the second set of metric indicia cooperates with the with the second pointer.

6. The adjustable wrench of claim 4 wherein at least some of the predetermined positions correspond to one of the nominal fastener sizes on the English scale and to one of the nominal fastener sizes on the metric scale.

7. The adjustable wrench of claim 4 wherein substantially all of the fixed positions provide a nominal metric unit wrench size and substantially all of the nominal English unit wrench sizes are paired with a nominal metric unit wrench size.

8. The adjustable wrench of claim 1 wherein the gear comprises a pinion gear and the immobilizing means comprises means for immobilizing the pinion gear.

9. The adjustable wrench of claim 8 wherein the wrench is generally planar having a central plane and the pinion gear provides an axis of rotation perpendicular to the central plane.

10. The adjustable wrench of claim 9 further comprising a shaft rigid with the gear mounting the gear for rotation about an axis of the shaft, means mounting the shaft for axial movement along the axis of the shaft between first and second positions and an abutment for engaging the gear in the first position of the shaft and immobilizing the gear.

11. The adjustable wrench of claim 10 wherein the abutment comprises a peg extending between the teeth of the gear in the first shaft position and away from the teeth of the gear in the second shaft position.

12. The adjustable wrench of claim 11 wherein the first scale element is a series of indicia arranged in an arc about the axis of rotation of the operator.

13. An adjustable wrench having a body providing a wrench handle, a first jaw rigid with the wrench handle, an adjustable jaw having a rack and means for moving the adjustable jaw relative to the first jaw comprising a gear having a multiplicity of teeth at least one of which meshes with the rack;

a shaft rigid with the gear mounting the gear for rotation about an axis of the shaft;

means mounting the shaft for axial movement along the axis of the shaft between first and second positions;

an abutment for engaging the gear in the first position of the shaft and immobilizing the gear and being out of engagement with the gear in the second position of the shaft;

a detent assembly operating between the wrench body and the gear for positioning the gear in one of a series of predetermined fixed positions;

a spring biasing the gear toward the first position of the shaft for normally immobilizing the gear; and an operator for rotating the gear and thereby reciprocating the rack and the adjustable jaw relative to the first jaw.

14. The adjustable wrench of claim 13 wherein the gear comprises a series of recesses on one face thereof and the detent assembly comprises at least one ball detent positioned to engage the recesses, the spring biasing the ball detent against the gear.

15. An adjustable wrench having a body providing a wrench handle having a first jaw and an adjustable second jaw cooperating to provide a wrench;

a scale having a first element on the body and a movable second element cooperating with the first element to show a first series of nominal fastener sizes in English units and a second series of nominal fastener sizes in metric units;

an operator for moving the adjustable jaw relative to the first jaw through a path of movement including a finite number of predetermined positions corresponding to the series of nominal fastener sizes so the nominal distance between the jaws in each of the predetermined positions corresponds to the nominal fastener sizes;

means for simultaneously moving the second element with the adjustable jaw;

first means cooperating between the fixed and adjustable laws for fixing the position of the adjustable law relative to the fixed law at each of the predetermined positions; and second means, in addition to the first means, for immobilizing the jaws in each of the predetermined positions.

16. The wrench of claim 15 wherein the first series of nominal fastener sizes is on one side of the wrench and the second series of fastener sizes is on an opposite side of the wrench.

17. The wrench of claim 15 wherein at least some of the predetermined positions correspond to one of the nominal fastener sizes on the English scale and to one of the nominal fastener sizes on the metric scale, wherein the first means includes a component at each of the predetermined positions for fixing the relative position of the adjustable jaw and the component which fixes the relative position of the adjustable jaw at one of the fastener sizes on the English scale also fixes the relative position of the adjustable jaw for a fastener size on the metric scale.

18. The wrench of claim 15 wherein substantially all of the positions provide a nominal metric unit wrench size and substantially all of the nominal English unit wrench sizes are paired with a nominal metric unit wrench size, wherein the first means includes a component at each of the predetermined positions for fixing the relative position of the adjustable jaw and the component which fixes the relative position of the adjustable jaw at one of the fastener sizes on the English scale also fixes the relative position of the adjustable jaw for a fastener size on the metric scale.

19. The wrench of claim 15 wherein the first means comprises a detent assembly.

20. The wrench of claim 15 further comprising a dial having a series of indicia on the fixed jaw indicative of the spacing between the fixed and adjustable jaws, and wherein the operator comprises an indicator mounted for movement adjacent the series of indicia for designating the spacing between the fixed and adjustable jaws.

* * * * *